US006061046A

United States Patent [19]

An

[11] Patent Number: 6,061,046

[45] Date of Patent: May 9, 2000

[54] LCD PANEL DRIVING CIRCUIT

[75] Inventor: Jong-Ki An, Kyeongsangbuk-do, Rep. of Korea

[73] Assignee: LG Semicon Co., Ltd., Chungcheongbuk-Do, Rep. of Korea

[21] Appl. No.: 08/929,791

[22] Filed: Sep. 15, 1997

[30] Foreign Application Priority Data

Sep. 16, 1996 [KR] Rep. of Korea ..... 96-40147

[51] Int. Cl.[7] ..... G09G 3/36

[52] U.S. Cl. ..... 345/98; 345/100; 345/204

[58] Field of Search ..... 345/98, 100, 204

[56] References Cited

U.S. PATENT DOCUMENTS

| | | | |
|---|---|---|---|
| 5,166,670 | 11/1992 | Takeda et al. | 345/100 |
| 5,359,343 | 10/1994 | Nakamura | 345/100 |
| 5,448,259 | 9/1995 | Hidaka | 345/98 |
| 5,570,105 | 10/1996 | Koyama | 345/98 |
| 5,657,040 | 8/1997 | Kanbara | 345/98 |
| 5,815,129 | 9/1998 | Jung | 345/98 |
| 5,894,299 | 4/1999 | Tsuchiya et al. | 345/100 |
| 5,986,632 | 11/1999 | Takayama et al. | 345/100 |

OTHER PUBLICATIONS

Texas Instruments Technical Manual for TMS 574B1, pp. 1–17, Apr. 1995.

*Primary Examiner*—Amare Mengistu
*Attorney, Agent, or Firm*—Morgan, Lewis & Bockius LLP

[57] ABSTRACT

An LCD panel driving circuit, includes a timing control circuit determining an output timing of a digital video signal and vertical/horizontal synchronizing signals and outputting the digital video signal and a row line driving signal, a D/A converter circuit coupled to the timing control circuit and receiving the digital video signal from the timing control circuit and outputting analog video signals to be sequentially applied to groups of column driver lines, a gamma correction circuit coupled to the D/A converter circuit and applying a correction signal to the D/A converter circuit, a sequence control circuit receiving the horizontal synchronizing signal and sequentially outputting a column driver enable signal, a column driver coupled to the sequence control circuit and the D/A converter circuit for sequentially receiving the analog video signals from the D/A converter circuit and subsequently outputting the analog video signals to different groups of column driver lines cell of a LCD panel, and a row driver receiving the row line driving signal from the timing control circuit and sequentially outputting the row line driving signal to each row line of the LCD panel.

18 Claims, 7 Drawing Sheets

LCD PANEL DRIVING CIRCUIT

This application claims the benefit of Korean Patent Application No. 96-40147 filed on Sep. 16, 1996, which is hereby incorporated by reference.

BACKGROUND OF THE INVENTION

1. Field of the Invention

The present invention relates to a liquid crystal display (LCD) device, and more particularly, to an LCD panel driving circuit. Although the present invention is suitable for a wide scope of applications, it is particularly suitable for reducing the size of the panel driving circuit as well as increasing the reliability of the device.

2. Discussion of the Related Art

An LCD is a display device utilizing transmissivity changes that occur when an electric field is applied to a liquid crystal material. In general, each pixel of a color LCD panel consists of three liquid crystal cells having a delta arrangement. Each cell outputs one of the video signals corresponding to R(red), G(green), and B(Blue). For a black and white display, the cells have a stripe arrangement. When those pixels are arranged in a matrix of rows and columns to form a display panel, a character signal or an image signal is outputted according to a control signal from the driving circuit.

As illustrated in FIGS. 1 and 2, 6-bit R, G, B digital video signals, a vertical synchronizing signal, V-SYNC, and a horizontal synchronizing signal, H-SYNC, for generating a cell driving signal of the LCD panel are inputted from a VGA chip to a timing control circuit 110. A digital video signal from the timing control circuit 110 is then applied to each column driver 120. A cell driving signal is applied to each row driver 130.

The timing control circuit 110 of the conventional LCD panel driving circuit controls the output timing of the digital video signal and transmits a cell driving signal to the row driver 130.

FIG. 2 illustrates the column driver 120 of the conventional LCD panel driving circuit shown in FIG. 1. The column driver 120 includes a shift block 121 for sequentially applying the video signal output from the timing control circuit 110 to a digital-to-analog (D/A) converter block 122. The D/A converter block 122 converts the digital video signal into an analog video signal. A gamma correction circuit 125 corrects the non-linear distortion of the video signal. A sample/hold circuit 123 outputs an analog video signal converted by the D/A converter block 122, and a buffer 124 applies an output from the sample/hold circuit 123 to each cell of the LCD panel.

In addition, a plurality of bus lines are required to apply the 6-bit digital video signals for transmission from the shift block 121 to the D/A converter block 122 of the low column driver 120. A plurality of signal transmission lines apply the converted analog video signal of the D/A converter block 122 to the buffer 124 through the sample/hold circuit 123.

The operation of the conventional LCD panel driving circuit as aforementioned will be described with reference to FIGS. 1 and 2.

If the digital video signal and the vertical/horizontal synchronizing signals V/H-SYNC are inputted to the timing control circuit 110, the timing control circuit 110 determines the output timing of the video signal input, transmits it to the column driver 120, and transmits the cell driving signal based on the vertical/horizontal synchronizing signals V/H-SYNC signals V/H-SYNC to the row driver 130.

The digital video signal is then applied to D/A converters in the D/A converter block 122 by the control of the shift block 121 in the column driver 120 of FIG. 2.

If a first data block of the digital video signal is inputted to the shift block 121, the signal is applied to the first three D/A converters D/A1, D/A2, D/A3 of the D/A converter block 122 to perform analog conversion. If a second data block is inputted, the signal is transmitted to D/A converters D/A4, D/A5, D/A6 of the D/A converter block 122 to convert the signal until all channels in the column driver 120 are converted. A converted analog video signal is then applied to each cell of the LCD panel 140 through the sample/hold circuit 123 and the buffer 124 to operate the LCD panel 140.

The conventional LCD panel driving circuit having the D/A converter block 122 in every column driver 120 requires an 18 bit-bus line in order to transmit 6-bit R, G, B digital video signals from the timing control circuit 110 to the column driver 120.

Therefore, each column driver 120 needs the D/A converter block 122 which increases the size of the circuit and also its power consumption. Moreover, since more bus lines are required to transmit the video signal between the timing control circuit 110 and the column driver 120, circuit malfunction caused by electromagnetic interference is a common problem. The entire size of the LCD panel driving circuit is thus increased and it takes more time to design the circuit. As a result, the cost per product is greatly increased.

SUMMARY OF THE INVENTION

Accordingly, the present invention is directed to an LCD panel driving circuit that substantially obviates one or more of the problems due to the limitations and disadvantages of the related art.

An object of the present invention is an LCD panel driving circuit that drastically reduces the size of the circuit by employing a single D/A converter circuit instead of a plurality of D/A converter circuits employed in every column driver of a conventional LCD panel driving circuit.

Another object of the present invention is an LCD panel driving circuit, employing only three bus lines for transmitting analog video signals converted by one D/A converter circuit instead of a plurality of bus lines for applying the digital video signals to the column driver in the conventional timing control circuit.

Yet another object of the present invention is an LCD driver circuit wherein the problem of electromagnetic interference is reduced.

Still another object of the present invention is a design for an LCD driver circuit that facilitates design and reduces the designing time so that the cost per display can be lowered.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an LCD panel driving circuit includes a timing control circuit for determining an output timing of a digital video signal and vertical/horizontal synchronizing signals and outputting the digital video signal and a row line driving signal, a D/A converter circuit coupled to the timing control circuit and receiving the digital video signal from the timing control circuit and outputting analog video signals to be sequentially applied to groups of column driver lines, a gamma correction circuit coupled to the D/A converter circuit and applying a correction signal to the D/A converter circuit, a sequence control circuit receiving the horizontal synchronizing signal and sequentially outputting a column driver enable signal, a column driver coupled to the sequence control circuit and the D/A converter circuit for sequentially receiving the analog video signals from the D/A converter circuit and subsequently outputting the analog video signals to different groups of column driver lines cell of a LCD panel, and a row driver receiving the row line driving signal from the timing control circuit and sequentially outputting the row line driving signal to each row line of the LCD panel.

In another aspect of the present invention, an LCD panel driving circuit includes a timing control circuit determining an output timing of a digital video signal and vertical/horizontal synchronizing signals and outputting the digital video signal and a row line driving signal, a D/A converter circuit coupled to the timing control circuit and receiving the digital video signal from the timing control circuit and outputting an analog video signal, a gamma correction circuit coupled to the D/a converter circuit and applying a correction signal to the D/A converter circuit, a sequence control circuit receiving the horizontal synchronizing signal, and sequentially outputting a column driver enable signal, a column driver coupled to the sequence control circuit and the D/A converter circuit sequentially receiving the analog video signal from the D/A converter circuit and collectively outputting the analog video signal to a column line cell of a LCD panel, and a row driver receiving the row line driving signal from the timing control circuit and sequentially outputting the row line driving signal to each row line of the LCD panel.

In a further aspect of the present invention, an LCD panel driving circuit includes a timing control circuit determining an output timing of a digital video signal and vertical/horizontal synchronizing signals and outputting the digital video signal and a row line driving signal, a D/A converter circuit coupled to the timing control circuit and receiving the digital video signal from the timing control circuit and outputting an analog video signal, the D/A converter circuit includes a latch for receiving the digital video signal from the timing control circuit and latching the digital video signal, a D/A converter receiving the digital video signal from the latch and converting into an analog video signal, and a buffer receiving the analog video signal from the D/A converter and outputting the signal to the column driver, a gamma correction circuit coupled to the D/A converter circuit and applying a correction signal to the D/A converter circuit, a sequence control circuit receiving the horizontal synchronizing signal and sequentially outputting a column driver enable signal, the sequence control circuit includes a first counter receiving a clock pulse signal and counting as many as the number of the channels in the column drivers, a second counter coupled to the first counter counting as many as the number of the column drivers, a first logic unit outputting a first reset signal to the first counter, a second logic unit outputting a second reset signal of the second counter, and a third logic unit receiving an output signal from the second counter and outputting a logic value "1" or "0", a column driver coupled to the sequence control circuit and the D/A converter circuit sequentially receiving the analog video signal from the D/A converter circuit and collectively outputting the analog video signal to a column line cell of a LCD panel, the column driver comprises includes a shift register receiving the column driver enable signal and outputting a output control signal, a sample/hold circuit receiving the analog video signal from the D/A converter circuit and sequentially operating the signal according to the control signal from the shift register, and a buffer receiving an output signal from a sample/hold module and outputting to the LCD panel, and a row driver receiving the row line driving signal from the timing control circuit and sequentially outputting the row line driving signal to each row line of the LCD panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF PREFERRED EMBODIMENT

Reference will now be made in detail to the preferred embodiments of the present invention examples of which are illustrated in the accompanying drawings.

Figure 1:
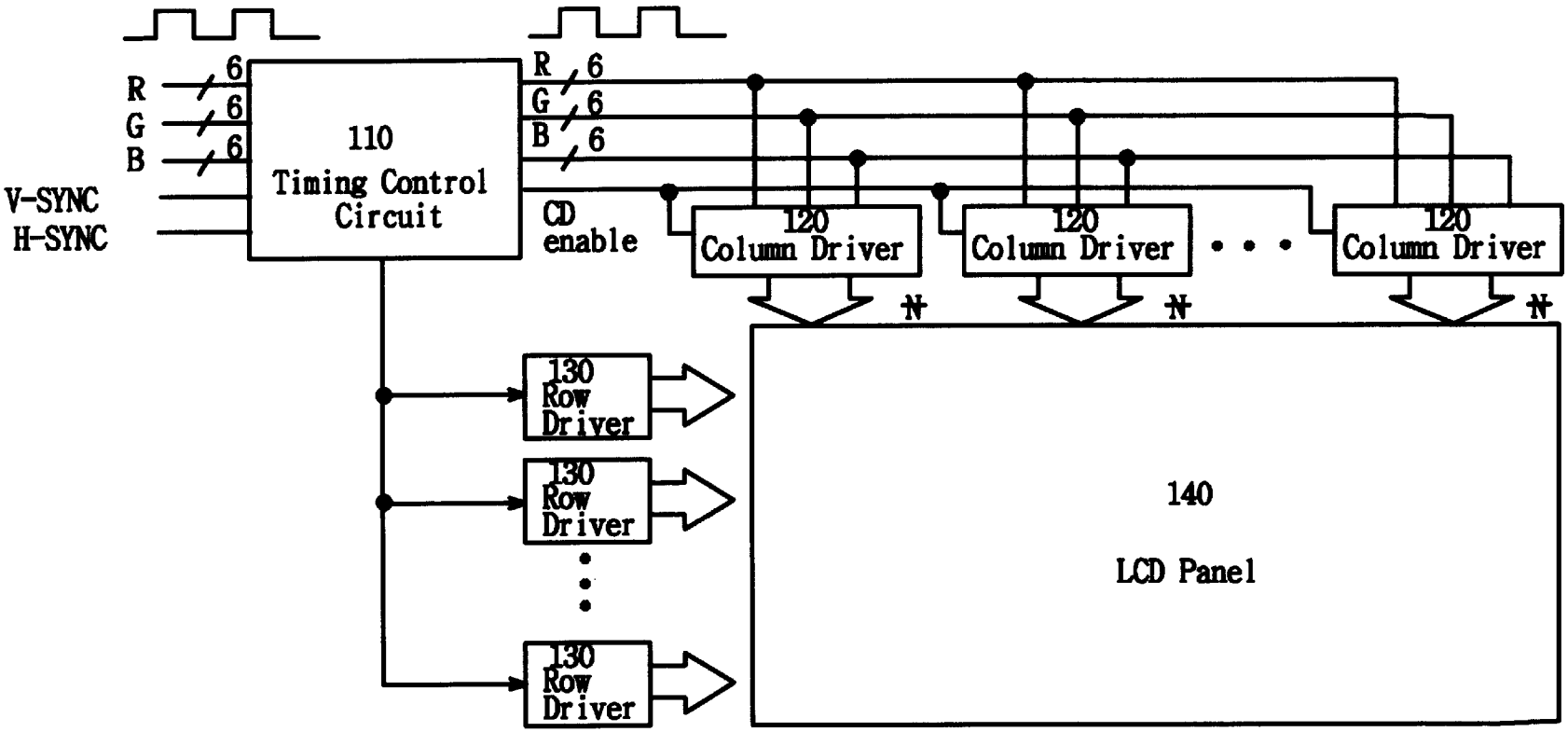
FIG.1 (Conventional Art)
FIG. 1 is a block diagram illustrating a conventional LCD panel driving circuit.
Figure 2:
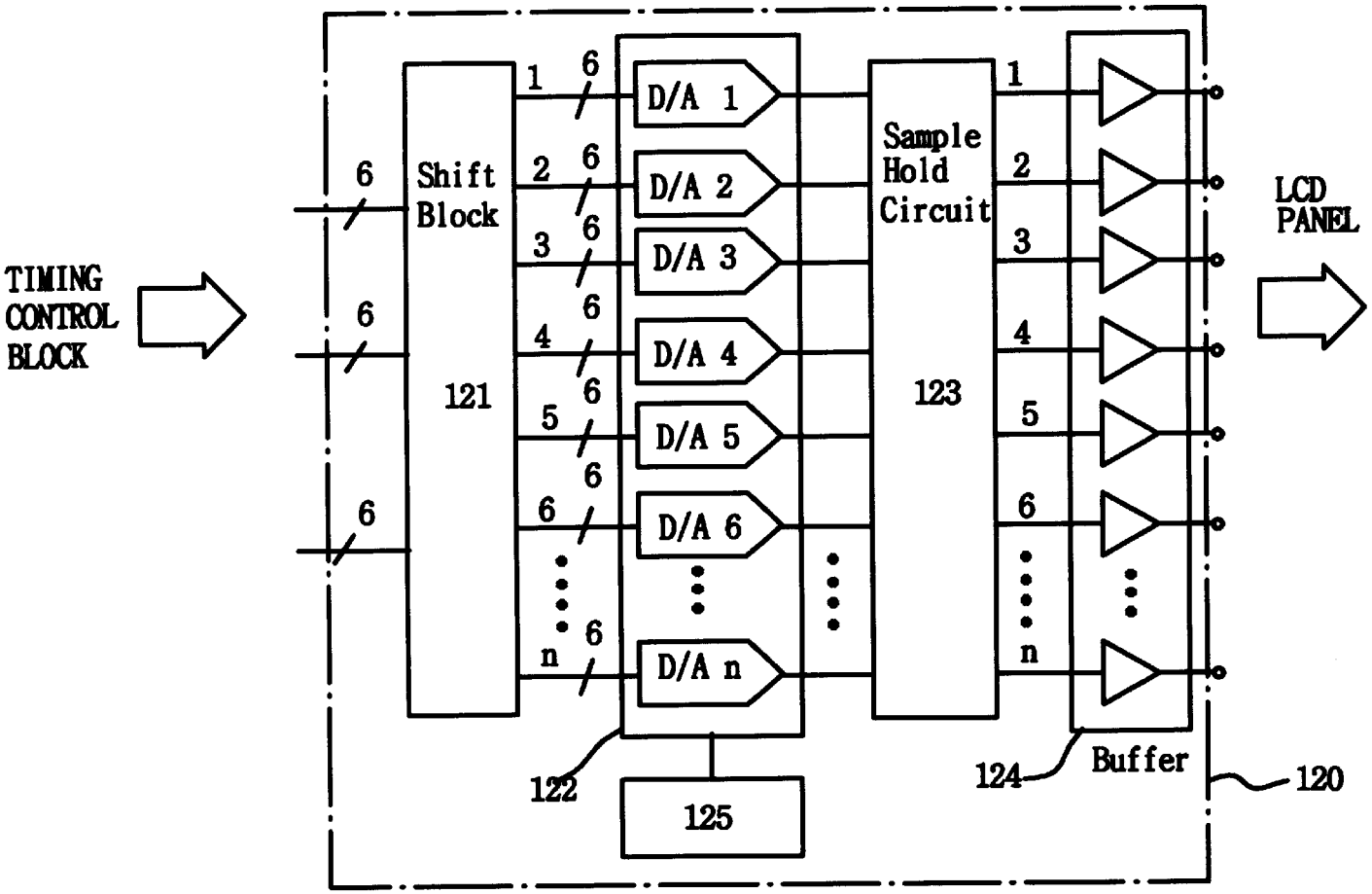
FIG.2 (Conventional Art)
FIG. 2 is a detailed block diagram illustrating of a column driver shown in FIG. 1.
Figure 3:
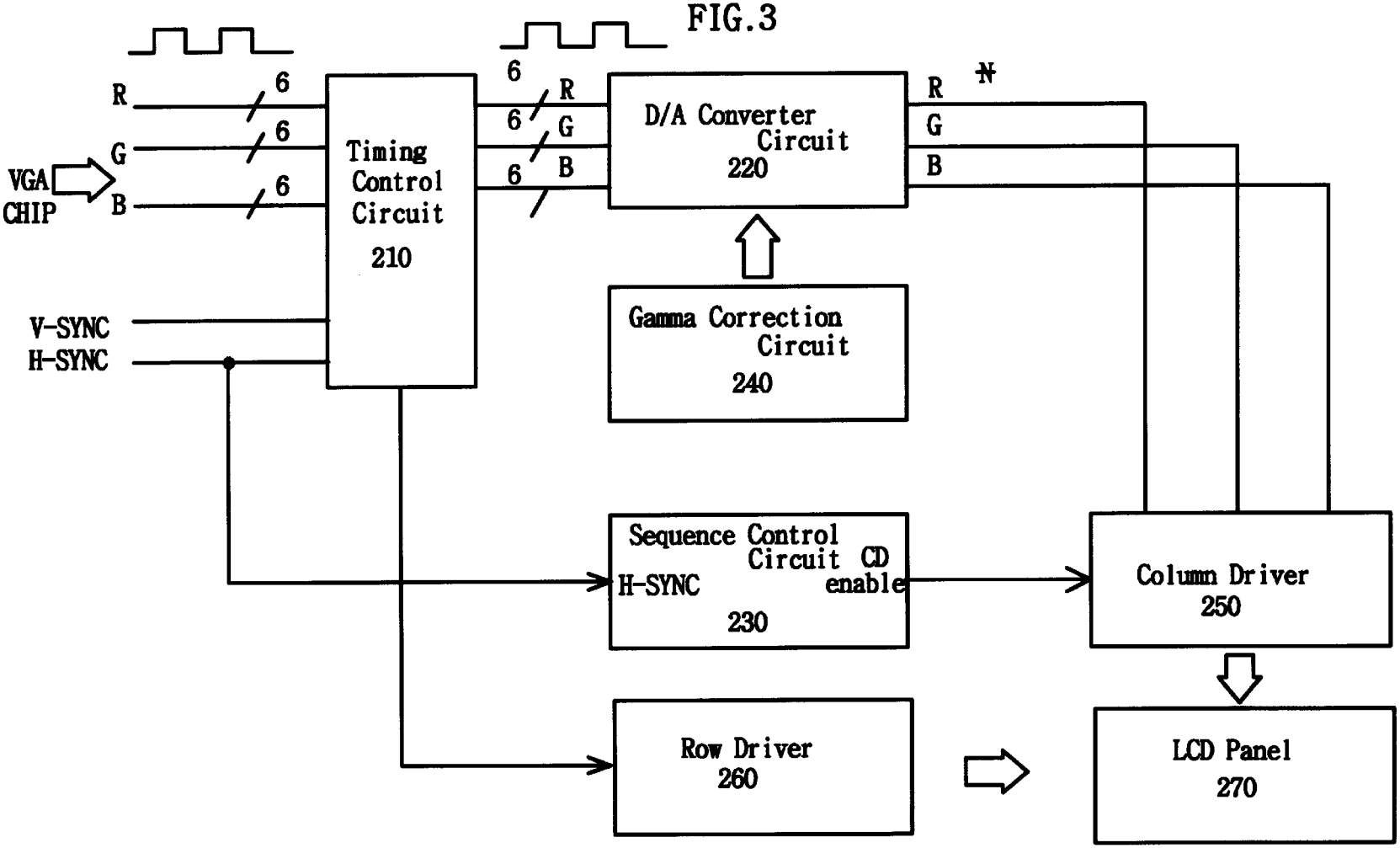
FIG. 3 is a block diagram of an LCD panel driving circuit according to a preferred embodiment of the present invention.

As illustrated in FIG. 3, a digital video signal and vertical/horizontal synchronizing signals V/H-SYNC are inputs to a timing control circuit 210. The vertical/horizontal synchronizing signals are applied to a row driver 260 and the digital video signal is transmitted to a D/A converter circuit 220. An analog video signal output from the D/A converter circuit 220 is applied to a column driver 250. A correction signal for correcting the non-linear distortion characteristic of the analog video signal outputted from a gamma correction circuit 240 is inputted to the D/A converter circuit 220. After receiving a horizontal synchronizing signal, H-SYNC, a sequence control circuit 230 outputs a column driving enable signal, CD-enable, to select a specific column driver and sequentially transmits the column driving enable signal, CD-enable, to each column driver 250.

Figure 4:
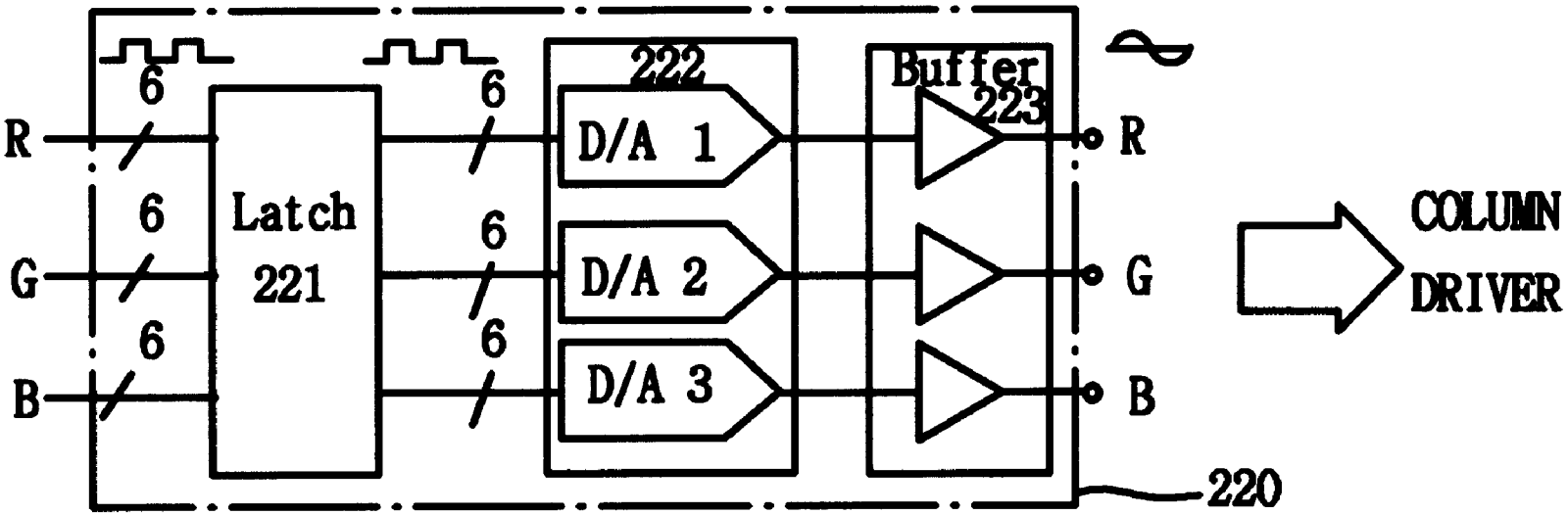
FIG. 4 is a detailed block diagram of a D/A converter circuit shown in FIG. 3 according to the embodiment of the present invention.

As illustrated in FIG. 4, the digital video signal from the timing control circuit 210 is applied to a D/A converter 222 through a latch 221. The analog output signal from the D/A converter 222 is outputted to a buffer 223.

Figure 5:
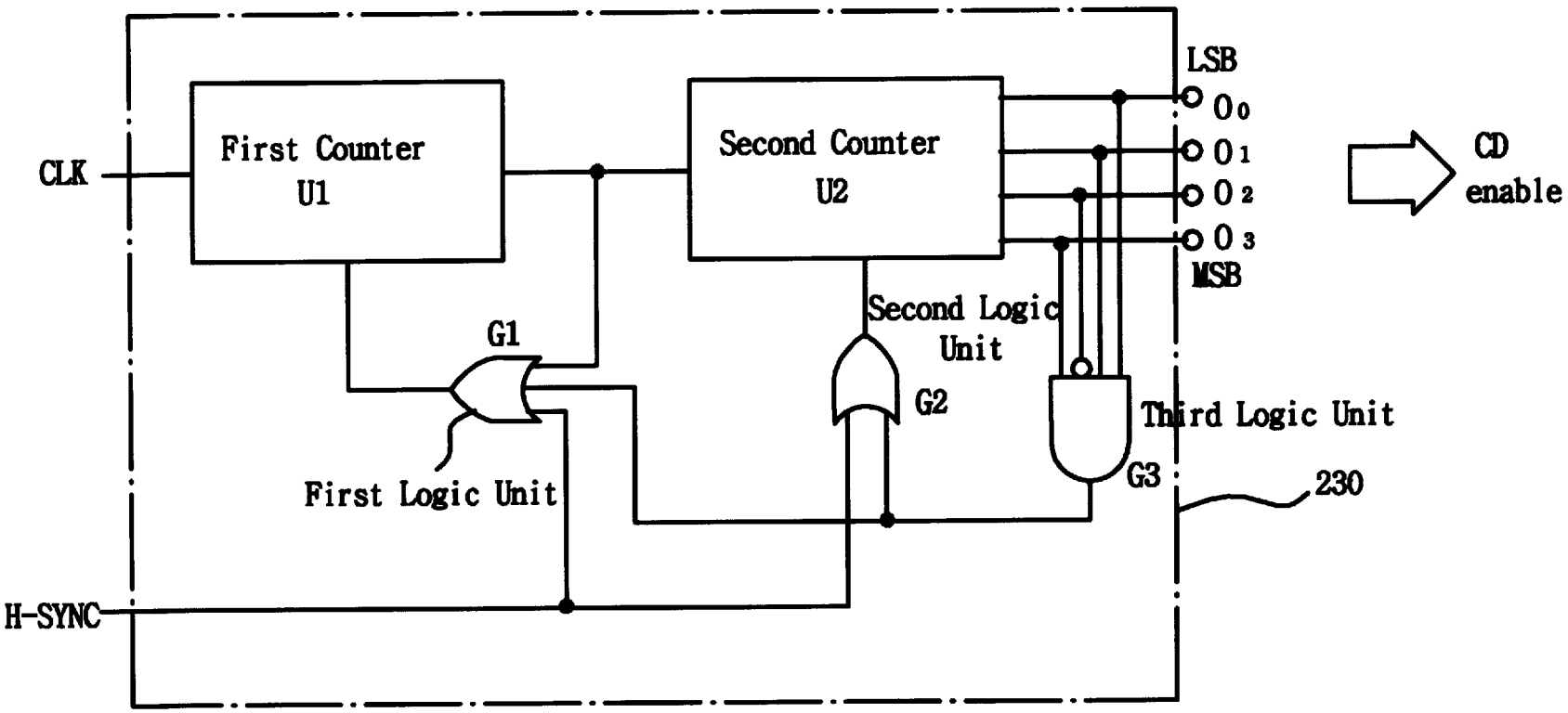
FIG. 5 is a detailed circuit diagram of a sequence control circuit shown in FIG. 3 according to the embodiment of the present invention.

As illustrated in FIG. 5, a first counter U1 receives a clock pulse signal and transmits an output to a second counter U2. A third logic circuit G3 (AND gate) receives an output of the second counter U2, and outputs a logic value "1" or "0". A first logic unit G1 (OR gate) receives the output signals from the first counter U1, the third logic unit G3, and the horizontal synchronizing signal H-SYNC and outputs a reset signal to the first counter U1. A second logic unit G2 (OR gate) receives the output of the third logic unit G3 and the horizontal synchronizing signal H-SYNC and outputs a reset signal to the second counter U2.

Figure 6:
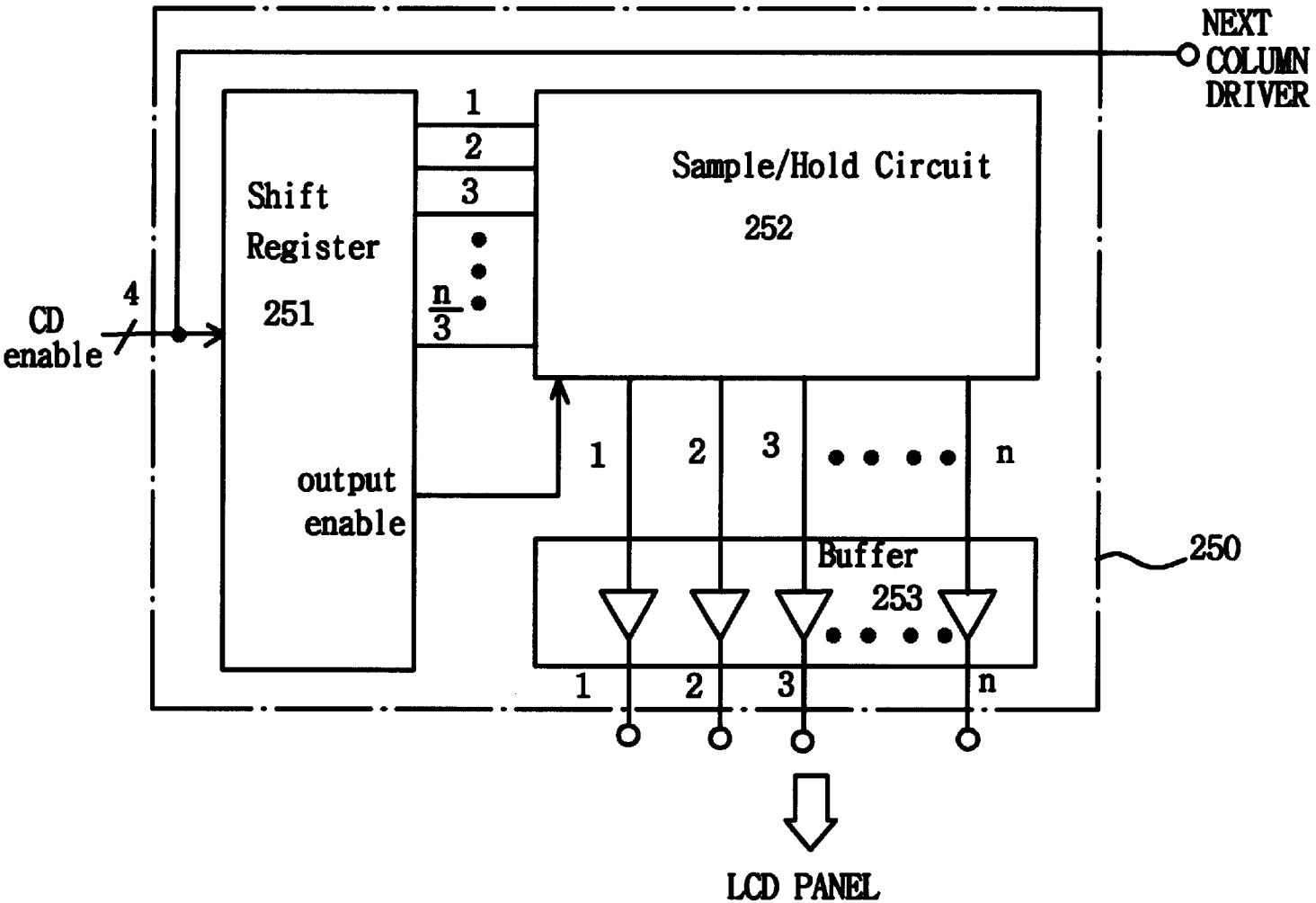
FIG. 6 is a detailed block diagram of a column driver shown in FIG. 3 according to the embodiment of the present invention.

As illustrated in FIG. 6, a control signal output from a shift register 251 is inputted to a sample/hold circuit 252. An output signal of the sample/hold circuit 252 is then applied to the LCD panel 270 through a buffer 253.

Figure 7:
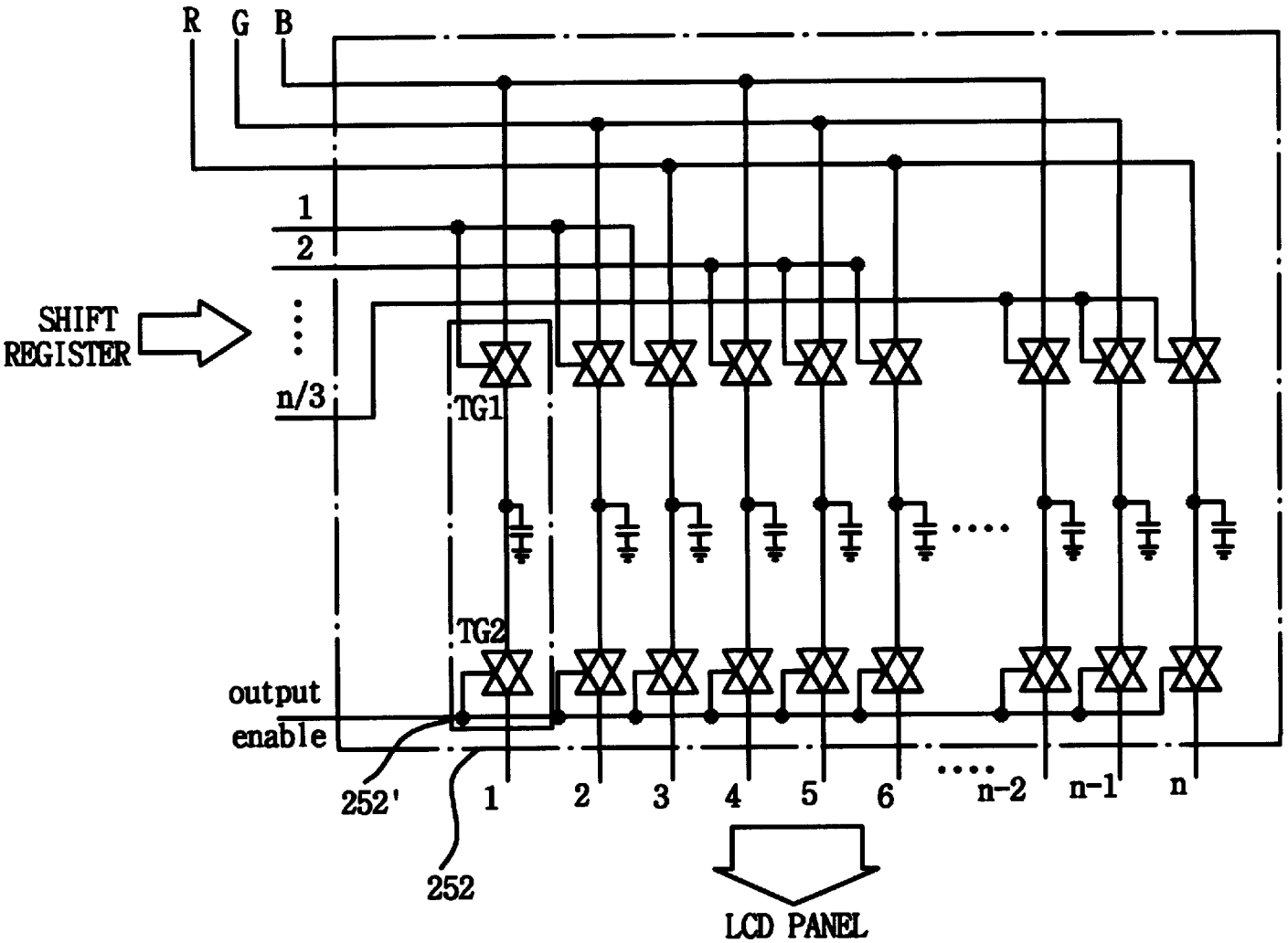
FIG. 7 is a detailed circuit diagram of a sample/hold circuit of the column driver shown in FIG. 6 according to the embodiment of the present invention.

As illustrated in FIG. 7, a plurality of sample/hold modules 252' are employed in the sample/hold circuit 252 shown in FIG. 6. Each control signal output from the shift register 251 is inputted to a group of three sample/hold modules 222'. The sample/hold module 222' is formed as follows. The video signal is inputted to a first transmission gate TG1 and sampled by the signal from the shift register 251. A second transmission gate TG2 and a capacitor C are connected in parallel to the first transmission gate TG1. An output of the second transmission gate TG2 controlled by the output control signal, Output-enable, is applied to the buffer 253 shown in FIG. 6.

The operation of the aforementioned LDC panel driving circuit will be described below with referenced to FIGS. 3 to 7.

When the digital video signal and the vertical/horizontal synchronizing signal V/H-SYNC are inputted to the timing control circuit 210, a cell driving signal by the vertical/horizontal synchronizing signal is applied to the row driver 260. The digital video signal is applied to the D/A converter circuit 220. The R, G, B digital video signals inputted to the D/A converter circuit 220 are converted into analog video signals by the D/A converter 222 and applied to the column driver 250 through the buffer 223. The gamma correction circuit 240 is employed to correct the non-linear distortion characteristic of the analog video signal.

Specifically, the operation of the sequence control circuit 230 is described as follows. The first counter U1 counts as many as the number of the channels mounted in the column driver 250 and then completes counting of one cycle. The signal of logic value "1" is then applied to the second counter U2 and simultaneously a signal is applied to a reset port of the first counter U1 through the second logic circuit G2 to reset the first counter U1.

The second counter U2 counts the signals applied from the first counter U1 and outputs a column driver selecting signal CD-enable at every count. When the count output of the second counter U2 equals the number of the column driver, the output of the second counter U2, as received by the third logic circuit G3, causes the third logic circuit G3 to output a logic signal of "1". When the signal of logic value "1" is inputted to the second logic circuit G2, the second logic circuit G2, for example, an OR gate, outputs the signal of logic value "1." The logic signal is then inputted to the reset port of the second counter U2 to reset the second counter U2.

For example, assuming the number of column drivers 250 is ten, the second counter U2 will eventually output the binary code "1011" corresponding to the decimal number "11." The second most significant bit "0" is inverted an input. The output of the third logic circuit G3 will become "1" to reset the first and second counters U1 and U2.

If the first column driver is selected by the column driver selection signal CD-enable of the second counter U2, the column driver 250 selected by the second counter U2 is driven and the remaining column drivers are not driven during the counting operation of the first counter U1. When the counting operation of one cycle of the first counter U1 is completed and the output data of the second counter U2 is increased by "1", the first column driver is not operated and the second column driver is selected and driven during the counting operation of another cycle. Thus, all the column drivers are selected and driven according to the above-mentioned sequential operation.

The operation of the column driver 250 selected by the column driver selection signal CD-enable is described as follows. When the column driver selection signal CD-enable is inputted to the shift register 251, a sample/hold module 252' is sequentially operated. In this process, the shift register 251 sequentially outputs the control signal so that the each sample/hold module 252' receives the control signal.

That is, when the first signal is outputted from the shift register 251, the first transmission gate TG1 at the first three sample/hold module 252' where the first signal is applied is opened. The R, G, B video signals thus are respectively inputted to the three sample/hold modules 252'. The capacitor C connected to the first transmission gate TG1 then is charged. On the other hand, when the second signal of the shift register 251 is outputted, the R, G, B video signals are respectively inputted to each first transmission gate TG1 of the next three sample/hold modules 252' to charge the capacitor C connected to the output terminal of the first transmission gate TG1.

When the charging of all the sample/hold modules 252' employed in the column driver 250 is completed, the second transmission gate TG2 of each sample/hold module 252' is opened by the output control signal Output-enable, so that the video signal charged in the capacitor C is applied to each cell forming the horizontal line in the LCD panel 270 through the buffer 253. When the video signal transmission to the horizontal line is completed the video signal is outputted by the cell driving signal of the row driver 260. The video signal output of the horizontal line is subsequently processed so that all the cells of the LCD panel 270 are driven to form a picture of the frame.

Accordingly, the present invention drastically reduces the size of the circuit by employing a single D/A converter circuit that substitutes for a plurality of D/A converter circuits employed in every column driver of the conventional LCD panel driving circuit. Also, by employing only three transmission lines for transmitting the analog video signal converted by one D/A converter circuit, in place of a plurality of bus lines for applying the digital video signals to the column driver in the conventional timing control circuit, electromagnetic interference caused by the number of wires is reduced in the present invention. Further, since the invention facilitates circuit design and reduces the designing time, the product unit cost is greatly reduced.

It will be apparent to those skilled in the art that various modifications and variations can be made in the LCD panel driving circuit of the present invention without departing from the spirit or scope of the invention. Thus, it is intended that the present invention cover the modifications and variations of this invention provided they come within the scope of the appended claims and their equivalents.

What is claimed is:

1. An LCD panel driving circuit, comprising:

a timing control circuit determining an output timing of a digital video signal and vertical/horizontal synchronizing signals and outputting the digital video signal and a row line driving signal;

a D/A converter circuit coupled to the timing control circuit and receiving the digital video signal from the timing control circuit and outputting analog video signals to be sequentially applied to groups of column driver lines;

a gamma correction circuit coupled to the D/A converter circuit and applying a correction signal to the D/A converter circuit;

a sequence control circuit receiving the horizontal synchronizing signal and sequentially outputting a column driver enable signal, the sequence control circuit having a plurality of counters and a plurality of logic units, at least one of the logic units outputting a logic value "1" or "0" based upon an output from at least one of the counters;

a column driver coupled to the sequence control circuit and the D/A converter circuit for sequentially receiving the analog video signals from the D/A converter circuit and subsequently outputting the analog video signals to different groups of column driver lines cell of a LCD panel; and a row driver receiving the row line driving signal from the timing control circuit and sequentially outputting the row line driving signal to each row line of the LCD panel.

2. The circuit according to claim 1, wherein the D/A converter circuit comprises:

a latch receiving the digital video signal from the timing control circuit and latching the digital video signal;

a D/A converter receiving the digital video signal from the latch and converting into an analog video signal; and a buffer receiving the analog video signal from the D/A converter and outputting the signal to the column driver.

3. The circuit according to claim 1, wherein the gamma correcting circuit corrects a non-linear distortion characteristic of the analog video signal from the D/A converter circuit.

4. The circuit according to claim 1, wherein the sequence control circuit comprises:

a first counter receiving a clock pulse signal and counting as many as the number of the channels in the column drivers;

a second counter coupled to the first counter counting as many as the number of the column lines;

a first logic unit outputting a first reset signal to the first counter;

a second logic unit outputting a second reset signal to the second counter; and a third logic unit receiving an output signal from the second counter and outputting a logic value "1" or "0".

5. The circuit according to claim 4, wherein the first logic circuit receives output signals from the first counter, the third logic circuit, and the vertical/horizontal synchronizing signal and outputs the first reset signal to the first counter.

6. The circuit according to claim 4, wherein the second logic unit receives an output from the third logic unit and the horizontal synchronizing signal and outputs the second reset signal to the second counter.

7. The circuit according to claim 4, wherein the third logic unit receives a binary logic signal output from the first counter and outputs a logic signal "1" to each of the first and second logic units when a logic signal larger than the number of the column drivers by "1" is inputted.

8. The circuit according to claim 1, wherein the column driver comprises:

a shift register receiving the column driver enable signal and outputting an output control signal;

a sample/hold circuit receiving the analog video signal from the D/A converter circuit and sequentially operating the signal according to the control signal from the shift register; and a buffer receiving an output signal from a sample/hold module and outputting to the LCD panel.

9. The circuit according to claim 8, wherein the sample/hold circuit includes a plurality of sample/hold corresponding to the column driver lines in a said group of column driver lines modules to output signals from the each sample/hold module through the buffer.

10. The circuit according to claim 8, wherein the sample/hold circuit receives a first control signal from the shift register inputted to a first three sample/hold modules and a second control signal from the shift register inputted to the next three sample/hold modules.

11. The circuit according to claim 8, wherein the sample/hold module comprises:

a first transmission gate receiving the analog video signal from the D/A converter and controlled by the control signal from the shift register, a second transmission gate and a capacitor connected to an output port of the first transmission gate in parallel; and an output port of the second transmission gate connected to the buffer.

12. An LCD panel driving circuit, comprising:

a timing control circuit determining an output timing of a digital video signal and vertical/horizontal synchronizing signals and outputting the digital video signal and a row line driving signal, a D/A converter circuit coupled to the timing control circuit and receiving the digital video signal from the timing control circuit and outputting an analog video signal, the D/A converter circuit comprises:

a latch for receiving the digital video signal from the timing control circuit and latching the digital video signal, a D/A converter receiving the digital video signal from the latch and converting into an analog video signal, and a buffer receiving the analog video signal from the D/A converter and outputting the signal to the column driver;

a gamma correction circuit coupled to the D/A converter circuit and applying a correction signal to the D/A converter circuit;

a sequence control circuit receiving the horizontal synchronizing signal and sequentially outputting a column driver enable signal, the sequence control circuit comprises:

a first counter receiving a clock pulse signal and counting as many as the number of the channels in the column drivers, a second counter coupled to the first counter counting as many as the number of the column drivers, a first logic unit outputting a first reset signal to the first counter, a second logic unit outputting a second reset signal of the second counter, and a third logic unit receiving an output signal from the second counter and outputting a logic value "1" or "0";

a column driver coupled to the sequence control circuit and the D/A converter circuit sequentially receiving the analog video signal from the D/A converter circuit and collectively outputting the analog video signal to a column line cell of a LCD panel, the column driver comprises:

a shift register receiving the column driver enable signal and outputting a output control signal, a sample/hold circuit receiving the analog video signal from the D/A converter circuit and sequentially operating the signal according to the control signal from the shift register, and a buffer receiving an output signal from a sample/hold module and outputting to the LCD panel; and a row driver receiving the row line driving signal from the timing control circuit and sequentially outputting the row line driving signal to each row line of the LCD panel.

13. The circuit according to claim 12, wherein the gamma correcting circuit corrects a non-linear distortion characteristic of the analog video signal from the D/A converter circuit.

14. The circuit according to claim 12, wherein the first logic circuit receives outputs from the first counter and the third logic circuit and the vertical/horizontal synchronizing signal and outputting the first reset signal to the first counter.

15. The circuit according to claim 12, wherein the second logic unit receives an output from the third logic unit and the horizontal synchronizing signal and outputting the second reset signal to the second counter.

16. The circuit according to claim 12, wherein the third logic unit receives a binary logic signal output from the first counter and outputting a logic signal "1" to each of the first and second logic units when a logic signal larger than the number of the column drivers by "1" is inputted.

17. The circuit according to claim 12, wherein the sample/hold circuit includes a plurality of sample/hold modules to output signals from the each sample/hold module through the buffer.

18. The circuit according to claim 12, wherein the sample/hold circuit receives a first control signal from the shift register being inputted to a first three sample/hold modules and second control signal from the shift register being inputted to the next three sample/hold modules.

* * * * *